US007708520B2

(12) United States Patent
Paolillo et al.

(10) Patent No.: US 7,708,520 B2
(45) Date of Patent: May 4, 2010

(54) GAS TURBINE ENGINE WITH CONCAVE POCKET WITH KNIFE EDGE SEAL

(75) Inventors: Roger E. Paolillo, Vernon, CT (US); Ioannis Alvanos, West Springfield, MA (US); Cheng-Zhang Wang, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 681 days.

(21) Appl. No.: 11/605,678

(22) Filed: Nov. 29, 2006

(65) Prior Publication Data

US 2008/0124215 A1 May 29, 2008

(51) Int. Cl.
*F01D 11/02* (2006.01)

(52) U.S. Cl. ..... 415/174.5; 415/230

(58) Field of Classification Search ..... 415/173.5, 415/173.6, 174.5, 230; 277/303, 412, 418, 277/419

See application file for complete search history.

(56) References Cited

U.S. PATENT DOCUMENTS 1,168,002 A 1/1916 Hirth
1,689,735 A 10/1928 Losel
1,756,958 A 5/1930 Schmidt
3,572,728 A * 3/1971 Smuland ..... 277/419
3,940,153 A * 2/1976 Stocker ..... 277/418
4,351,532 A 9/1982 Laverty
4,477,088 A 10/1984 Picard
4,477,089 A 10/1984 Hoffman et al.
5,029,876 A * 7/1991 Orlando et al. ..... 277/419
5,161,943 A 11/1992 Maier et al.
5,211,535 A 5/1993 Martin et al.
5,224,713 A 7/1993 Pope
5,630,590 A 5/1997 Bouchard et al.
5,639,211 A 6/1997 Bintz
6,000,701 A 12/1999 Burgess
6,102,655 A * 8/2000 Kreitmeier ..... 415/173.3
6,164,655 A * 12/2000 Bothien et al. ..... 277/303
7,445,213 B1 * 11/2008 Pelfrey ..... 277/418

* cited by examiner

*Primary Examiner*—Ninh H Nguyen
(74) *Attorney, Agent, or Firm*—Carlson, Gaskey & Olds

(57) ABSTRACT

A gas turbine engine is provided with turbine sealing structures including knife edge seals which extend at an angle relative to an axial center line of the engine. Each knife edge seal is associated with a concave pocket defined between a radially inner surface and a spaced radially outer surface. The concave pockets and their associated knife edge seals create a pair of vortices which prevent leakage into radially inner portions of the turbine section.

9 Claims, 3 Drawing Sheets

GAS TURBINE ENGINE WITH CONCAVE POCKET WITH KNIFE EDGE SEAL

BACKGROUND OF THE INVENTION

This application relates to knife edge seals which rotate with a gas turbine rotor, and are associated with concave pockets in a stationary sealing surface. The combination of the knife edge seals and the concave pockets create vortices, which limit leakage past the knife edge seals.

Gas turbine engines are known, and typically include a series of sections. Generally, a fan delivers air to a compressor section. Air is compressed in the compressor section, and delivered downstream to a combustor section. In the combustor section, air and fuel are combusted. The products of combustion then pass downstream over turbine rotors. The turbine rotors rotate to create power, and also to drive the fan and compressors.

The turbine rotors typically are provided with a plurality of removable blades. The blades are interspersed with stationary surfaces, and stationary vanes. It is desirable to limit leakage of the products of combustion radially inwardly of the turbine blades. Thus, the turbine blades are provided with knife edge seals which are spaced closely from sealing surfaces on the static members.

In the prior art, labyrinth seal structures are known. Generally, the sealing surfaces have been formed as cylindrical surfaces at a plurality of different radial distances. The combination of these different radial distances, and a plurality of associated knife edge blades create a labyrinth path for leakage fluid to limit it reaching radially inner locations in the gas turbine engine. Even so, some leakage does occur, and it would be desirable to further reduce the leakage.

SUMMARY OF THE INVENTION

In a disclosed embodiment of this invention, the generally cylindrical sealing surfaces of the prior art are replaced by concave pockets. The pockets generally are defined between a radially inner surface spaced from a radially outer surface. As the products of combustion flow, they are forced into the pockets in a swirling movement. Vortices form in the pockets, and block or limit leakage.

At the same time, in a disclosed embodiment, knife edge seals are associated with the pockets. The knife edge seals preferably extend at an angle of at least 30° and less than 90° relative to an axial center line of the gas turbine engine. By angling the knife edge seals further vortices are provided that also limit leakage. The combination of the angled knife edge seals and the concave pockets provide vortices at each of several radially spaced sealing locations.

These and other features of the present invention can be best understood from the following specification and drawings, the following of which is a brief description.

DETAILED DESCRIPTION OF THE PREFERRED EMBODIMENT

Figure 1:
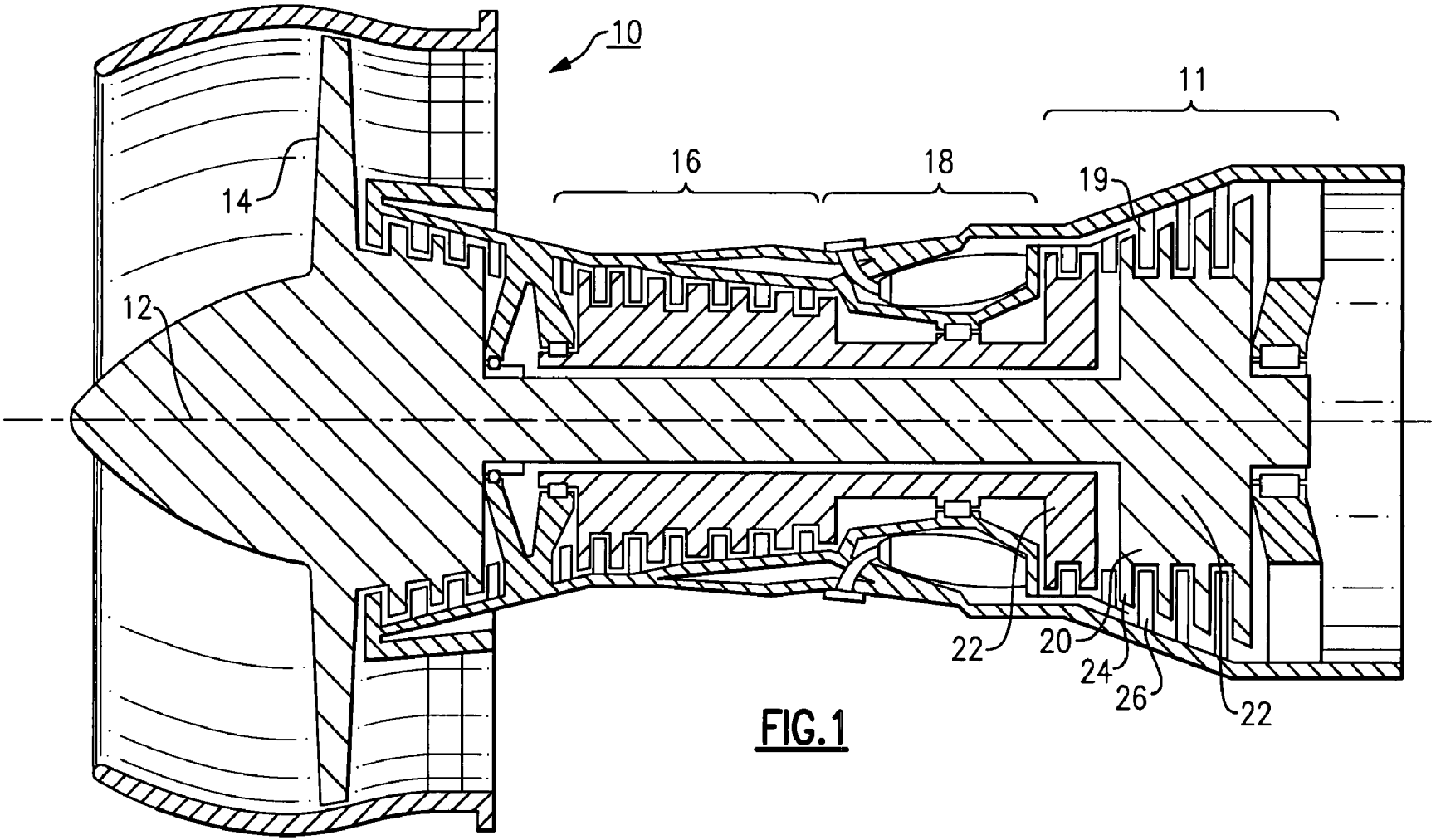
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan 14, a compressor 16, a combustion section 18 and a turbine 20. As is well known in the art, air compressed in the compressor 16 is mixed with fuel and burned in the combustion section 18 and expanded in turbine 20. The turbine 20 includes rotors 22 which rotate in response to the expansion, driving the compressor 16 and fan 14. The turbine 20 comprises alternating rows of rotary airfoils or blades 24 and static airfoils or vanes 26. In fact, this view is quite schematic, and blades 24 and vanes 26 are actually removable. It should be understood that this view is included simply to provide a basic understanding of the sections in a gas turbine engine, and not to limit the invention. This invention extends to all types of turbine engines for all types of applications.

Figure 2:
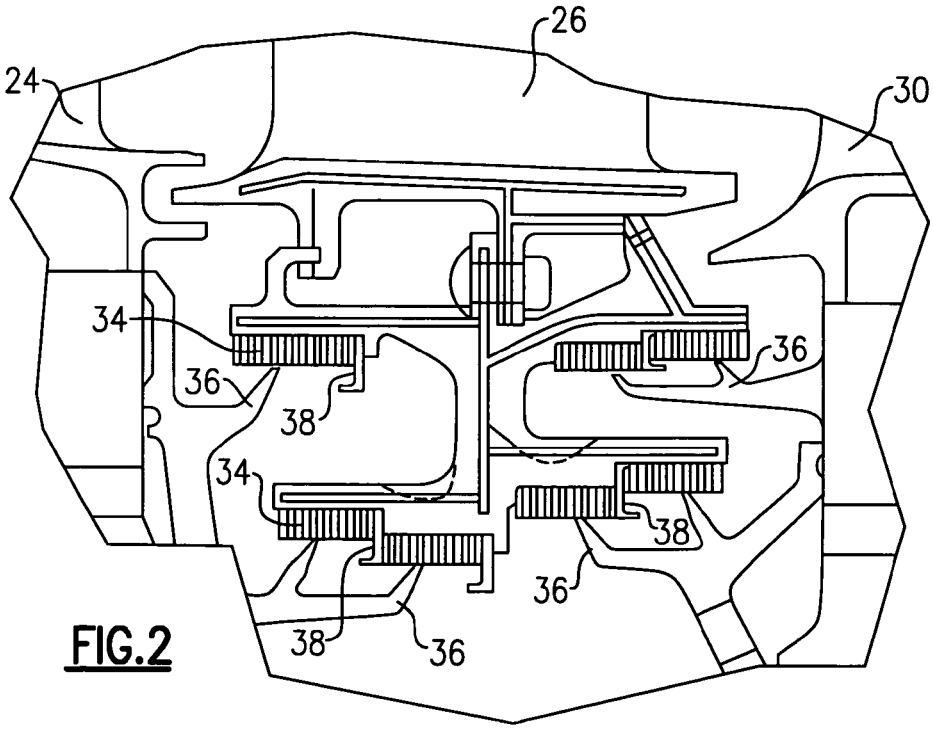
FIG. 2 shows a sample sealing location with a gas turbine engine of the present invention.

FIG. 2 is an enlarged view of turbine blades 24, and intermediate stationary vanes 26. As known, sealing surfaces 34 are associated with knife edge seals 36. As can be seen in this figure, in the present invention, these knife edge seals extend at an angle relative to the axial centerline 12 of the jet engine. Also, the knife edge seals are associated with concave pockets 38, as will be explained in more detail below. As can be appreciated in at least some of the locations, there are a plurality of radially spaced sealing pockets and associated knife edge blades.

Figure 3A:
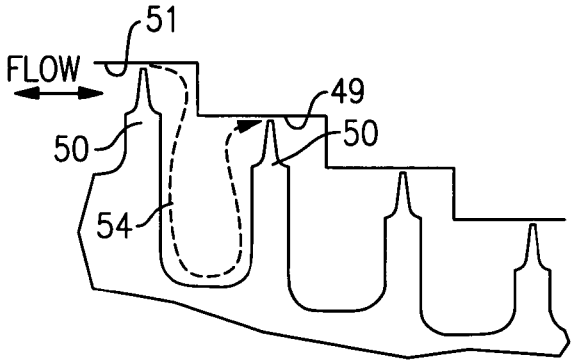
FIG.3A Prior Art
FIG. 3A shows a prior art seal.

As shown in FIG. 3A, in the prior art, a labyrinth seal was created by cylindrical sealing surfaces 49 and 51 spaced at different radial positions, and knife edge seals 50 spaced from the associated static sealing surfaces 51 and 49. As known, and as shown for example in FIG. 2, an abradable sealing material may actually be positioned to allow the knife edge seal to wear the material and provide a close fit. With the radially distinct sealing surfaces 49 and 51, a labyrinth leakage path 54 is presented to any fluid which may leak radially inwardly of the rotor. The labyrinth seal path does provide a good restriction to linkage fluid. However, it would be desirable to even further improve the resistance of this path.

Figure 3B:
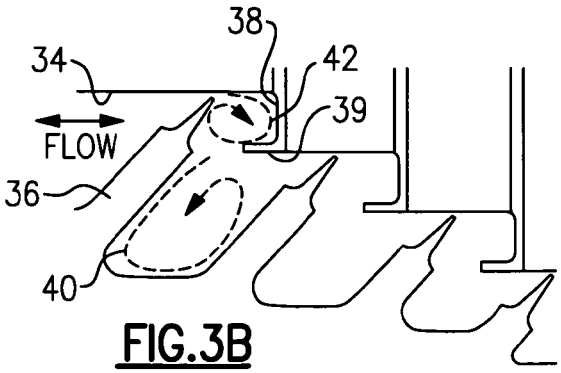
FIG. 3B shows a first sealing arrangement.

Thus, as shown in FIGS. 2 and 3B, fluid can be forced into vortices 40 and 42 by angling the knife edge seals 36 relative to a central line of the gas turbine engine, and creating pockets 38 from radially inner walls 39 and a radially outer wall 34. A vortex 42 is created in the pocket 38, and the angled knife edge seal 36 creates yet another vortex 40. The combination of the vortices 40 and 42 present a great resistance to fluid leakage. This is particularly true when there are additional knife edge seals at different radial positions, and positioned along a path of the fluid flow, as shown in FIG. 3B. In FIG. 3B, the knife edge seals 36 are angled into the pockets 38.

Figure 3C:
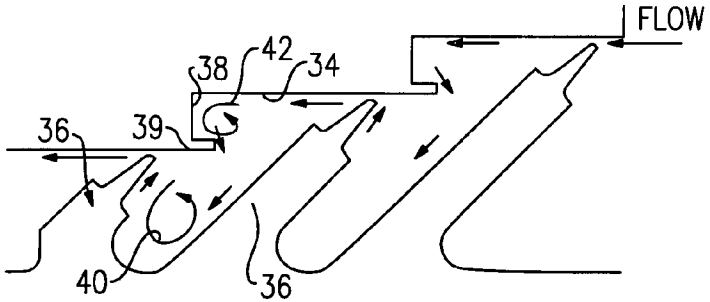
FIG. 3C shows a second sealing arrangement.

As shown in FIG. 3C, a similar vortex pair can be created if the knife edge seals 36 are angled away from the pockets 38. Again, vortices 42 and 40 are created and function as mentioned above.

The present invention thus provides a great resistance to leakage flow by utilizing angled knife edge seals and associated concave pockets. Several possible arrangements of these two concepts are shown in FIG. 4-7. In FIGS. 4-7 it can be understood that fluid is flowing from the right to the left.

Figure 4:
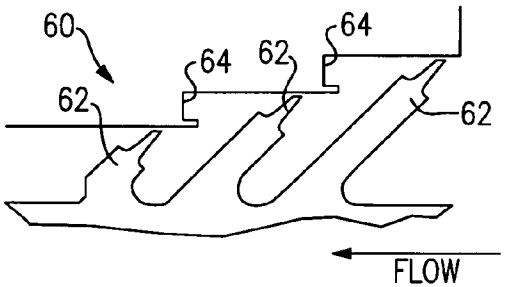
FIG. 4 shows one embodiment of the present invention.

As shown in FIG. 4, in embodiment 60, knife edge seals 62 are angled into the flow, and the pockets 64 face the flow of fluid. This arrangement will create vortices as mentioned above.

Figure 5:
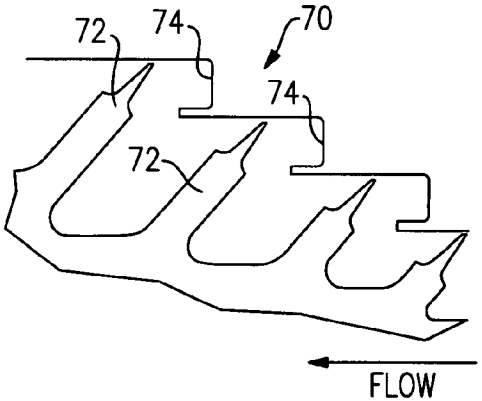
FIG. 5 shows another embodiment of the present invention.

FIG. 5 shows an embodiment 70 where the knife edge seal 72 are angled into the path of the fluid, however, the pockets 74 face away from the path of the fluid. This configuration is preferred when the rotating structure that is the rotor and carries the knife edge seals, are already in place, and the static structure is being assembled from an aft to forward position.

Figure 6:
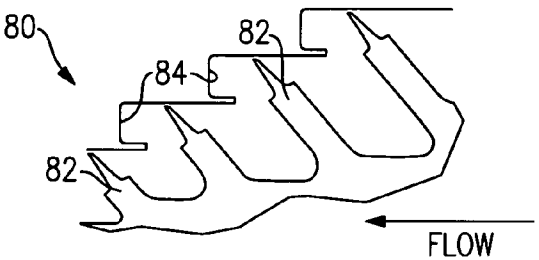
FIG. 6 shows another embodiment of the present invention.

FIG. 6 shows an embodiment 80 wherein the knife edge seals 82 are angled along the path of the flow, and the pockets 84 face the path of the flow. This embodiment is particularly well suited when the static structure is in place and the rotating structure is moved from an aft location to a forward location for assembly.

Figure 7:
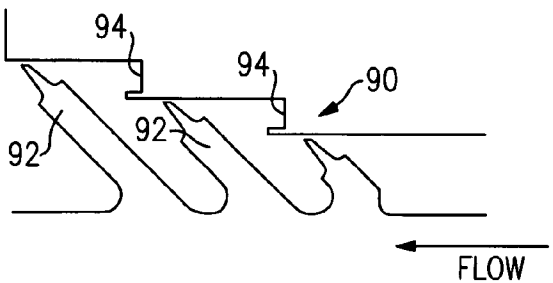
FIG. 7 shows yet another embodiment of the present invention.

An embodiment 90 is illustrated in FIG. 7. In embodiment 90 the knife edge seals 92 are angled along the path of flow, and the pockets 94 face away from the path of flow. This configuration is well-suited for when the rotating structure is in place and a static structure is moved from an aft location to a forward location.

In FIGS. 4-7, the flow direction could be stated with regard to the location of the components such as shown in FIG. 1. As an example, the combustor would be upstream in the FIGS. 4-7 embodiments. Thus, a component "facing into" the flow could alternatively be said to be "facing the combustion section." Also, a component which "faces away" from the flow could be said to "face away" from the combustion section.

As can be appreciated, in the FIG. 6 embodiment, the greater outer diameter knife edge seals are positioned upstream, and lesser outer diameter knife edge seals are positioned downstream. Also, the knife edge seals extend along an angle such that they extend toward the pockets. The angle is non-parallel, and non-perpendicular, to a central axis.

As known in the art, a "knife-edge seal" includes a sealing member at an outermost point which narrows to a tip, such that the tip is smaller than portions spaced more radially inwardly.

The present invention thus provides concave pockets formed of a radially inner surface spaced from a radially outer surface. The concave pockets create a vortex in the fluid flow which prevents leakage past the associated knife edge seal. Further, when the knife edge seals are angled, they create a second vortex further limiting leakage flow. The angle of the seals may range between 30 and 90° in example embodiments.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A turbine assembly for a gas turbine engine comprising:

at least one rotor rotating about an axis, said rotor being provided with rotor blades, and said rotor and rotor blades being radially spaced from static structure, said rotor and rotor blades having knife edge seals extending close to at least a portion of said static structure to provide a seal, and said static structure having concave pockets associated with at least a plurality of said knife edge seals, said concave pockets being defined by a radially inner surface spaced from a radially outer surface;

said knife edge seals extend along a non-perpendicular angle relative to said axis; and said knife edged seals are angled along a path heading in a downstream direction.

2. The assembly as set forth in claim 1, wherein said concave pockets create a vortex in fluid flow leaking past an associated knife edge seal.

3. The assembly as set forth in claim 1, wherein at least some of said concave face in an upstream direction.

4. A assembly as set forth in claim 1, wherein at least some of said concave pockets face in a downstream direction.

5. The assembly as set forth in claim 1, wherein there are a plurality of sealing surfaces on said static structure at distinct radial distances from said axis, and said plurality of sealing surfaces each having an associated concave pocket, and an associated knife edge seal.

6. A turbine assembly for a gas turbine engine comprising:

at least one rotor rotating about an axis, said rotor being provided with rotor blades, and said rotor and rotor blades being radially spaced from static structure, said rotor and rotor blades having knife edge seals extending close to at least a portion of said static structure to provide a seal, and said static structure having concave pockets associated with at least a plurality of said knife edge seals, said concave pockets being defined by a radially inner surface spaced from a radially outer surface;

said knife edge seals being angled to be non-parallel, and non-perpendicular, to said axis, with said angle of said knife edge seals extending in a direction towards said concave pockets; and there being an upstream direction and a downstream direction, with a plurality of sealing surfaces on said static structure at distinct radial distances from said axis, and said plurality of sealing surfaces each having an associated one of said concave pockets, and at least a first of said knife edge seals extending for a radially greater distance, and at least a second of said knife edge seals extending for a radially lesser distance, with said second knife edge seal being positioned downstream relative to said first knife edge seal.

7. The turbine assembly as set forth in claim 1, wherein said knife edge seals are angled relative to an axis of rotation of said rotor, and such that each said knife edge seal is angled into one of said concave pockets, and said concave pockets face in an upstream direction.

8. The turbine assembly as set forth in claim 1, wherein said knife edge seals each have a radially outermost portion which provides a tip, and is spaced from a body of said rotor by portions which have a greater thickness than said tip.

9. The turbine assembly as set forth in claim 6, wherein said knife edge seals each have a radially outermost portion which provides a tip, and is spaced from a body of said rotor by portions which have a greater thickness than said tip.

* * * * *